US005282384A

United States Patent [19]

Holbrook

[11] Patent Number: 5,282,384

[45] Date of Patent: Feb. 1, 1994

[54] METHOD FOR CALCULATING SEDIMENTARY ROCK PORE PRESSURE

[75] Inventor: Phil Holbrook, Houston, Tex.

[73] Assignee: Baroid Technology, Inc., Houston, Tex.

[21] Appl. No.: 956,609

[22] Filed: Oct. 5, 1992

[51] Int. Cl.[5] ..... E21B 49/00

[52] U.S. Cl. ..... 73/152; 73/382 R; 364/422

[58] Field of Search ..... 73/155, 151, 152, 382; 364/420, 422

[56] References Cited

U.S. PATENT DOCUMENTS

| | | | |
|---|---|---|---|
| 4,805,449 | 2/1989 | Das | 73/151 |
| 4,809,545 | 3/1989 | Lyle | 73/382 R |
| 4,833,914 | 5/1989 | Rasmus | 73/152 |
| 4,981,037 | 1/1991 | Holbrook et al. | 73/152 |

(List continued on next page.)

OTHER PUBLICATIONS

Article, "Density-Depth Correlation in Po Valley Sediments" by A. Gandino and C. Zenucchini, vol. XXIX, N. 115—Sep. 1987.

Article, "Inversion of Borehole Gravimeter Data" by Jeffrey D. MacQueen, LCT Inc. Borehole Geophysics 3: Hardware and Methods.

Article, "Ways of Deciphering Compacted Sediemtns" by Brewster Baldwin Journal of Geophysical Research, vol. 69, N. 2, Jan. 15, 1964.

Article, "Estimation of Formation Pressures from Log-Derived Shale Properties", by C. E. Hottman et al., (1965).

Article, "North Sea Application of Seismic Correlative and Seismic Velocity (ITT) Techniques to Predict Pore Pressure", by Michael A. Haas, (1990).

Article, "Undisturbed Clay Samples and Undisturbed Clays", by Karl Terzaghi, (1941).

Article, "Influence of Depth, Temperature, and Geologic Age on Porosity of Quartzose Sandstone[1]", by John C. Maxwell, (1964).

Article, "Sandstone Porosity as a Function of Thermal Maturity" by James W. Schmoker et al., (1988).

Article "Compaction of Basin Sediments: Modeling Based on Time-Temperature History" by James W. Schmoker and Donald L. Guatier, (1989).

Article, "Compaction Curves[1]" by Brewster Baldwin and Crispin O. Butler, (1985).

Article, "A Petrophysical-Mechanical Math Model for Real-Time Wellsite Pore Pressure/Fracture Gradient Prediction" by P. W. Holbrook et al., (1987).

Article, "Explicit Pore-Pressure Evaluation: Concept and Application" by Jean-Louis Alixant et al., (1991).

(List continued on next page.)

*Primary Examiner*—Robert J. Warden
*Assistant Examiner*—Hien Tran
*Attorney, Agent, or Firm*—Browning, Bushman, Anderson & Brookhart

[57] ABSTRACT

An improved technique more accurately determines pore pressure of sedimentary rock penetrated by a borehole from the earth's surface. Formation overburden is directly measured at one or more locations in the borehole, and a log of formation overburden is generated using the measured overburden pressures and conventional geophysical data. A linear relationship has been determined between the logarithm of effective stress for a specific mineral and the logarithm of solidity, which allows the maximum effective stress and the compaction exponent for that mineral to be determined. This linear relationship enables the effective stress and compaction exponent for rock comprising a combination of minerals to be precisely determined at multiple borehole intervals. The effective stress and overburden calculated according to the techniques to the present invention are particularly useful to geologist and well planners in the oil and gas industry.

23 Claims, 4 Drawing Sheets

U.S. PATENT DOCUMENTS

| | | | |
|---|---|---|---|
| 5,081,612 | 1/1992 | Scott et al. | 367/38 |
| 5,142,471 | 8/1992 | Desbrandes | 73/155 |
| 5,144,589 | 9/1992 | Hardage | 73/152 |
| 5,165,274 | 11/1992 | Thiercelin | 73/151 |

OTHER PUBLICATIONS

Article, "A Dual Shale Pore Pressure Detection Technique" by T. M. Bryant, (1989).

Article, "A New Method for Predicting Fracture Propagation Pressure from MWD or Wireline Log Data" by P. W. Holbrook, (1989).

Article, "An Accurate Rock Merchanics Approach to Pore Pressure/Fracture Gradient Prediction" by Phil Holbrook, (1990).

Article, "Regional Fractures II: Fracturing of Mesaverde Reservoirs in the Piceance Basin, Colorado[1]" by John C. Lorenz and Sharon J. Finley, (1991).

Article, "Diagenesis of Saline Pan Halite; Comparison of Petrographic Features of Modern, Quaternary and Permaian Halites[1]" by Enrique Casas and Tim K. Lowenstein, (1989).

Article, "Compressional Velocity and Porosity in Sand-Clay Mixtures" by D. Marion et al., (1992).

Article, "The Distribution of Shale in Sandstones and Its Effect Upon Porosity" by E. C. Thomas and S. J. Stieber, (1975).

Article, "Elastic-Plastic Deformation of Anhydrite and Polyhalite as Determined From Quasi-Static Triaxial Compression Tests" by Tom W. Pfiefle and Paul E. Senseny, (1981).

Article, "The Effect of Decrease in Porosity With Depthon Future Development of Oil and Gas Reserves in South Louisiana" by G. I. Atwater and E. E. Miller, (no date given).

Article, "Real-Time Pore-Pressure Evaluation from MWD/LWD Measurements and Drilling-Derived Formation Strength" by J. C. Rasmus et al., (1991).

Article, "How to Predict Formation Pressure and Fracture Gradient", The Oil and Gas Journal, (1967).

Article, "Compaction of Lithic Sands: Experimental Results and Applications" by Edward D. Pittman, (1991).

Article, "Estimating Thermal Conductivity in Sedimentary Basins Using Lithologic Data and Geophysical Well Logs[1]" by Frederic Brigaud et al., (1990).

METHOD FOR CALCULATING SEDIMENTARY ROCK PORE PRESSURE

BACKGROUND OF THE INVENTION

1. Field of Invention

The present invention relates to an improved method for calculating the pressure of fluid contained in a sedimentary rock which has been naturally compacted under the influence of gravity. A more accurate calculated pore pressure profile at various depth ranges produced according to the method of this invention produces valuable geological information useful in the hydrocarbon recovery industry.

2. Background

Pore fluid pressure is the major factor affecting the planning and drilling of an oil well. The borehole fluid hydrostatic pressure must be greater than the formation pore fluid pressure if one is to avoid the possibly catastrophic risk of blowout. Likewise, the borehole fluid circulating pressure must be less than fracture propagation pressure if one is to avoid the risk of lost circulation. Several expensive casing strings are usually required so that an oil well can be drilled within these two pore fluid pressure and fracture propagation pressure limits. The present invention thus enhances the safety of oil or gas well drilling operations, and also reduces the overall cost of hydrocarbon recovery by providing more reliable information to a drilling operator and thus avoiding complicated correction operations.

Because of its critical relationship to drilling operations, there are numerous techniques for calculating pore fluid pressure. All known petrophysical prior art methods calculate pore fluid pressure indirectly based upon measured rock properties, e.g., rock density or drilling rate of penetration. Most of these methods follow a calibration procedure which is not based on mechanical or physical information. Instead, these calibration procedures are generally based upon an observed empirical relationship between a measured physical parameter and a "normal" or hydrostatic compaction trend. The "normal" trend line is the average value of the measured parameter which changes as a function of depth. The change in the measured parameter according to these prior art techniques is thus related to a change in compaction of the sedimentary rock.

Sedimentary rocks are compacted by the stress applied to their grain matrix framework, which is not solely function of depth. When fluid pressure is approximately hydrostatic and the overburden is gradually increasing, both depth and stress are increasing. Under these conditions, depth behaves as a pseudo-stress variable. However, when pore pressure is elevated, effective stress and overburden gradients can be either increasing or decreasing and depth is not a pseudo-stress variable. Most of the prior art methods for determining pore fluid pressure use depth as a pseudo-stress variable in both "normal" and "excess" pressured intervals which results in significant pore pressure calculation errors.

Another significant failing of prior art pore pressure calculation techniques is attributable to their basic formulation. According to prior art techniques, pore pressure (P) is calculated as a sum of "normal" hydrostatic fluid pressure (Pn) which is inferred from compaction-depth trend, plus a differential or "excess" fluid pressure (ΔP) which is related to a measured difference from the "normal" trend. The equation expressing this relationship is:

$$P = Pn + \Delta P \quad (1)$$

Equation 1 is a physically incorrect mathematical formulation. In fact, Pascal's Principle requires that all of the fluids in a given local pore space or container be at the same pressure. Since the "excess" pressure term (ΔP) does not exist in nature, there is no way it can be physically related to a measured parameter. Calibrating a measured physical parameter to a quantity which does not exist (ΔP) is not reasonably sound.

The "normal compaction" vs depth trend line methods give the drilling operator a false sense of confidence based entirely upon the hydrostatic (Pn) calibration interval, wherein depth is a pseudo-stress variable. Pascal's Principle is not violated in the upper hydrostatic (Pn) interval because $\Delta P = 0$ and $P = Pn$. Unfortunately, this sense of confidence gained in the (Pn) calibration interval is then transferred to the associated empirical "excess" pressured (ΔP) calibration where two entirely different conditions apply.

In the "excess pressured" interval, depth is not a pseudo-stress variable. Also, the change in the measured physical parameter, such as density, resistivity, or rate of penetration, is related according to this prior art technique to the positive (ΔP) term of Equation 1, which violates Pascal's Principle. Apparent success of pore pressure predictions derived from these methods below the base of the hydrostatically compacted interval may be due to a coincidence between pressure and depth which is peculiar to a given area or depth range. Any correspondence between calculated and observed pore pressures cannot be attributed to a physical relationship between the measured parameter and the excess fluid pressure, however, because such a relationship does not physically exist.

Lacking a physical cause-effect relationship, these prior art methods have been judged on a raw observed pressure vs. hydrostatic fluid pressure (Pn) trend basis. The (ΔP) calibration correlates the difference between the observed measurement and the projected (Pn) normal compaction trend. There is no data to support the (Pn) projection below the top of the overpressured (ΔP) zone because known pressure (P) is above (Pn). Consequently, all these methods include depth below the base of (Pn) as a contributing calibration factor. To make these "calibrations" work, similar depth-pore pressure profiles are taken within a given study area. What is presumed to be pore pressure prediction accuracy using these methods is actually a raw vs an averaged form of the same pressure data within a given area. The scatter of data about its own average trend is more commonly known as measurement precision. A narrow scatter within a given study area, such as reported in a 1965 article by Hottman et al., actually also means that depth-pore pressure profiles are similar within the area. In that case, the only measurement that is needed to successfully predict pore pressure is the measured depth to the top of the overpressured zone. A paper published that same year by Matthews et al shows both positively and negatively curving correlations of (ΔP) to resistivity in different study areas and depth ranges. If there was a direct correlation between resistivity and pore pressure, one would expect one relationship or the other, but not both. The dozens of pore pressure methods in practice today which follow the $P = Pn + \Delta P$ formulation violate a law of physics in their fluid pressure calibration and are flawed since they are not based on valid theories.

U.S. Pat. No. 4,833,914 to Rasmus is an example of a $P=Pn+\Delta P$ method which violates Pascal's Principle. Rasmus volumetrically subdivides total rock porosity into overpressured porosity, effective porosity, and water porosity. A response equation solver then uses these terms to solve for pore pressure. As all fluid molecules are free to exchange position with each other through Brownian movement, there is no boundary between these artificially calculated pore volumes and no natural way to define them. The overpressured pore volume used by Rasmus is also a ($\Delta P$) term which exists in the same total pore space as "normally pressured" pore volume, which further violates Pascal's Principle. The method uses complicated statistics to converge on these artificially calculated, physically non-existent pore volume terms. This patent discloses pressure results being calculated in shales only from the "overpressured porosity" term. Although this calibration technique is performed statistically with a computer, it has the same physical shortcomings of the methods described in the previous paragraph.

U.S. Pat. No. 5,081,612 to Scott et al discloses a method for determining formation pore pressure from remotely sensed seismic data. This particular method and the prior art methods cited in this patent depend upon a hydrostatically compacted reference velocity profile. Referring back to Equation 1, this profile is essentially an observed or inferred curved (Pn) velocity gradient. The Scott et al pore pressure gradient technique applies to only one lithology, which is common to most of the prior art methods using a $P=Pn+\Delta P$ formulation. Pore pressures are calculated with respect to the reference velocity gradient, which again is a violation of Pascal's Principle.

A 1990 article by Haas presented a seismic data pore pressure method which accounts for the difference in formation velocity which is a function of lithology and not pore pressure. These lithologic changes are "normalized" out by either addition or subtraction to make a smooth (Pn) velocity trend. After normalization, a velocity overlay is developed which empirically relates $P=Pn+\Delta P$ by using lithology normalized velocity as the measured parameter. To operate properly, this Haas method would require all lithologies to compact in the same manner after normalization. Different lithologies did not compact similarly before their transit time offset normalization, and there is no logical basis to presume that they would compact similarly after offset normalization. The Haas procedure does not make rock compactional sense, and results derived therefrom should be suspect.

There are at least three prior art methods for determining pore fluid pressure from petrophysical measurements which are based upon the effective stress law, which was first elucidated by Terzaghi in 1923 through compactional studies of marine sediments:

$$P=S-\sigma_v \quad (2)$$

This relationship states that the fluid pressure in the pore space (P) can be calculated as the difference between the total overburden load (S) and the load borne by the sediment grain-grain contacts ($\sigma_v$). In the science of rock and soil mechanics, this $\sigma_v$ term is known as the effective stress. Effective stress law is not widely used today for pore pressure prediction for various reasons, including the absence of an effective $\sigma_v$ calibration technique.

Effective stress was ignored by most geologic compaction studies, which instead evaluated geologic compaction as depth - porosity functions. Overburden gradients which differ considerably from place to place were assumed to be equal or uniformly varying. Although pore pressure was mentioned as a possible explanation for porosity differences, it was not subtracted from the total overburden load (S) to calculate effective stress. The mechanical effective stress explanation for the differences in porosity vs depth trends were thus ignored by geologists. The differences between porosity vs depth compaction curves were instead attributed to geologic factors such as geologic age and temperature. Articles by Maxwell published in 1964, and by Schmoker et al in 1988 and 1989, evidence this explanation.

A 1972 article by Baldwin et al unified the compaction of shales worldwide through use of a power law solidity vs depth relationship. These researchers re-cast the then-standard shale porosity vs depth curves, noting that each of the compaction curves from 14 worldwide basins fell within 2% of the Baldwin et al worldwide average power law solidity vs depth relationship. These researchers then substituted effective stress ($\sigma_v$) for depth in a power law equation of the same form:

$$\sigma_v=\sigma_{max}\,(\text{Solidity})^{\alpha+1} \quad (3)$$

In this equation, the $\sigma_{max}$ term is the power law intercept of the compaction curve with the 100% solidity axis. $\sigma_{max}$ is the effective stress that will cause complete compaction of the sedimentary particle mixture. $\alpha+1$ is the slope of the power law compaction function for that granular material. This seemingly simple mathematical substitution transformed the Baldwin et al unified depth (pseudo-stress) empirical compaction function into a mechanically sound stress-strain relationship. The critical difference between this and all other compaction functions is that effective stress is the load applied to the sedimentary rock grain matrix framework. Solidity is a linear function of the compactional strain experienced by that rock grain matrix framework. Calibration using this equation represents a sound cause-effect relationship based on valid mechanical theories. However, Baldwin et al made no attempt to calculate pore pressure using this approach. The accompanying discussion of sandstone compaction curves in the Baldwin et al article indicated that sandstone compaction was apparently not governed by power law functions. The observed wide variance between sandstone compaction curves between different basins apparently suggested to them that no unified sandstone compaction function was possible.

A 1987 article by Holbrook et al and U.S. Pat. No. 4,981,037 applied the effective stress law for pore pressure prediction using a power law effective stress compaction function. The initial $\sigma_{max}$ and, $\alpha+1$ constants used were expressed in the Baldwin et al article. The method was highly successful at predicting pore pressures in mid-shelf and off-shelf Gulf Coast sandstone-shale sequences. However, very deep highly sand prone wells forced a change of the effective stress constants $\sigma_{max}$ and $\alpha$ to higher values than suggested by Baldwin et al. The revised constants include the effects of pore pressure and are based upon calculated stress rather than pseudo-stress. The revised constants are more accurate and cover a broader depth and stress range than the Baldwin et al constants.

1989 and 1992 articles by Alixant also disclose the use of the effective stress law for pore pressure prediction. However, Alixant used a single laboratory derived compaction function, which he applied to shales only. In field testing, the compaction constant could not accurately cover the range of shale solidities. This method requires considerable changes in unrelated non-physical constants to match observed pore pressure data within a given local area. It is known, however, that strain hardening changes the compaction function of a rock. A constant laboratory compaction function can calculate stress from strain accurately only where the constant coincidentally matches the changing compaction function.

Another 1989 article by Bryant also disclosed an attempt to use the effective stress law for pore pressure prediction. Bryant used an average exponential function to calculate overburden as a function of depth rather than data from the well. His results were inaccurate partially because of this average exponential function, and partially because he used the same compaction function for sandstones and shales. Bryant's methods in not in common use today, possibly due to these large inaccuracies.

Holbrook extended the effective stress concept to the prediction of vertical fracture propagation pressure in a 1989 article. This approach was at least 4 times more accurate than prior art fracture pressure methods. Leakoff tests calibrated using this effective stress method all fell at or below the calculated overburden for that depth. Kehle noted in a 1964 article that all his observed onshore leakoff tests fell below the calculated overburden. However, neither the Kehle nor Holbrook articles used this observation as a feedback mechanism to improve the calculation of formation pore fluid pressure.

The disadvantages of the prior art are overcome by the present invention, and improved and techniques are hereinafter disclosed for more accurately calculating pore pressure of sedimentary rock which has been naturally compacted under the influence of gravity. The techniques of the present invention provide more meaningful pore pressure profiles which are useful in the hydrocarbon recovery industry.

SUMMARY OF INVENTION

The present invention provides an improved technique based on sound mechanical theories for calculating the pressure of fluid contained in a sedimentary rock which has been naturally compacted under the influence of gravity.

The effective stress portion of the method encompasses both internal and external measures of rock grain matrix strain. Thus the same effective stress calibration can be applied equally well to externally measured rock thickness data and petrophysically measured rock porosity data. The power law effective stress-strain relationship for any sedimentary rock can be determined from the weighted average of the power law functions of the minerals which compose that sedimentary rock.

The overburden calibration portion of the method takes advantage of an upper limiting relationship between leakoff tests to sub-horizontal fracture propagation pressure and a lower leakoff test limit of sub-vertical fracture propagation pressure. All leakoff tests within a given well or local area can be used for calibration. Barring other mechanical problems, all measured leakoff tests should fall within these two borehole fluid pressure limits which are related to the far field stresses.

It is an object of this invention to provide improved techniques for both calculating sedimentary rock pore pressure, and for graphically depicting pore pressure data in a manner which facilitates understanding of geological factors and thus geophysical analysis.

It is the feature of this invention that an initial overburden may be more accurately determined that in prior art techniques utilizing leakoff pressure test data. It is a further feature of this invention that the maximum effective stress of a mineral is related as a power law function. Still a further feature of this invention is that a linear relationship of effective stress of a mineral may be used to accurately extrapolate the effective stress for a rock containing a mixture of minerals.

A significant advantage of the present invention is that additional and costly equipment is not necessary in order to make more accurately determinations of sedimentary rock pore pressure. A further advantage of this invention is that the technique may be used for various combinations of rock containing different mineral compositions.

These and further objects, feature, and advantages of the present invention would become apparent from the following detailed descriptions, wherein reference is made to the FIGURES in the accompanying drawings.

DETAILED DESCRIPTION OF THE PREFERRED EMBODIMENT

The practical application of the effective stress law to pore pressure prediction requires accurate estimates of overburden stress (S) and accurate estimates of effective vertical stress ($\sigma_v$) from compactional strain data. An error of 200 psi or more in the combined pore pressure calculation would seriously limit the usefulness of any well-site pore pressure prediction method. Techniques for calculating or estimating these stress values are described separately below.

1. Overburden stress - leakoff test calibration

The most reliable known measurement of overburden stress requires the use of a borehole gravimeter which must be clamped and held steady in a borehole for about ½ hour so that a stable measurement can be made. Two borehole gravimeter readings are used for this stress measurement technique to estimate overburden at any given depth. An initial calibration reading is required to measure the earth's gravity at the surface. If the well location is offshore, this surface is average sea level. At least one additional borehole gravimeter reading is needed from a depth that is close to the top of the available petrophysical log data. In a 1989 article, Mac Queen describes this method for inverting these borehole gravimeter measurements to determine overburden at the top of the petrophysically logged interval. Drilling operators rarely order this service, however, because it is very expensive and there is a high risk of getting a clamped tool stuck in the borehole, thereby incurring even more expense.

Fortunately, drilling operations do routinely perform leakoff tests almost every time they set casing. The principal application of this measurement is to test the casing seat cement job and to determine how far they can raise static mud weight before having to set another protective casing string. After cementing protective steel casing in place, the operator will usually drill the cement out of the casing plus an additional few feet of new formation. If the cement job is good (as it usually is), the leakoff test actually provides valuable information about earth far field stresses from the few feet of open borehole which is immediately below the casing shoe.

In most drilling operations, the shallowest leakoff test and uppermost petrophysical measurements are usually taken hundreds to thousands of feet below the earth's surface. Initial overburden stress from the unlogged upper portion of the hole can easily vary by 200 psi from an average compaction curve depending on the overburden lithology, sediment compaction and initial formation pore pressure. Using the effective stress law, any error in initial overburden psi would be carried as a constant offset to all subsequent pore pressure calculations for that well.

Figure 1:
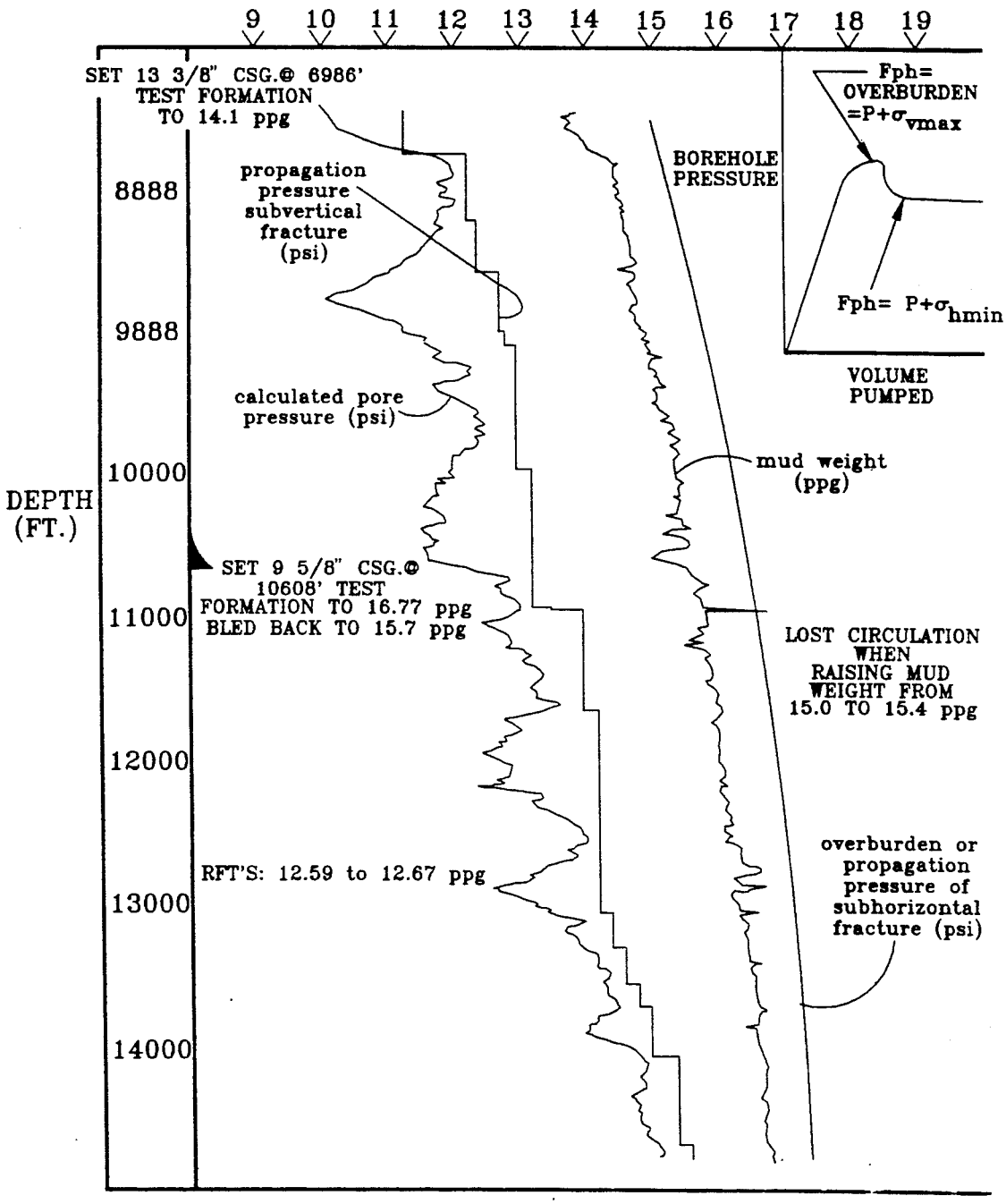
FIG. 1 graphically displays for a well bore calibrated pore pressure, mud weight, propagation pressure sub-vertical fracture, and overburden pressure (which is equated with sub-horizontal fracture propagation pressure) according to the techniques of the present invention.

Within the petrophysically logged portion of a borehole, the additional incremental overburden stress can be calculated very accurately using Equation 1 and lithologic constants disclosed in U.S. Pat. No. 4,981,037. According to the present invention, continuous overburden stress, pore pressure and fracture propagation pressure logs can be constructed using these equations and methods, as shown in FIG. 1. By using the whole log, both leakoff tests and the lost circulation pressure of 15.4 ppg (pounds per gallon) at a depth of 10860 feet can be used as constraints on the initial overburden value of 15.0 ppg at 6986 feet. An initial overburden stress gradient of 15.0 ppg at 7370 feet resulted in a match between observed and calculated fracture pressure within 30 psi for all three leakoff test and lost circulation measurements. The initial overburden stress selected from leakoff test comparison was 100 psi lower than that of an average normally compacted overburden containing 30% sandstone.

A leakoff test measures the weakest point in the open borehole. If the casing cement job is good, the weakest point is usually an existing fracture in the few feet of open borehole. Natural fractures are caused by and geometrically related to the far field stresses. Bedding plane fractures are almost always present. Sub-horizontal bedding plane fractures have essentially no tensile strength and are held closed only by the maximum principal stress which is overburden. Consequently, overburden is the upper leakoff pressure limit in an open borehole through sub-horizontally bedded rocks.

Results and conclusions drawn from open borehole leakoff tests should not be confused with results derived from laboratory experiments. Laboratory test rocks must be specially machined to fit into triaxial cells. The samples are not representative of most subsurface rocks. Rocks which can be machined without falling apart are ordered from a few quarries which are well known to the laboratory experimenters. The machined samples are selected to avoid natural fractures. Consequently, laboratory experiments include the effects of rock tensile strength in their measured fracture pressures. Rock tensile strength is usually several hundred to several thousand PSI, depending on lithology and average confining stress. Unfractured laboratory rock fracture pressures have yield phenomenon similar to that observed during leakoff tests. However, laboratory measured pressures are much higher because this measurement includes rock tensile strength. Laboratory equivalent fracture initiation pressures are thus hardly ever reached in open bore holes during leakoff tests because natural fractures are opened first at lower pressures. The open borehole leakoff test is usually stopped at this point, and no new fractures are initiated. Pressures required to initiate new fractures which occur in laboratory experiments are hardly ever reached in the field.

Leakoff tests are performed on natural rocks which usually contain abundant natural fractures, as more fully explained in a 1991 article by Lorenz et al. In addition to bedding plane fractures, there typically is also another set of sub-vertical tensile fractures which are oriented perpendicular to the least principal horizontal stress. If the short open borehole intersects one of these fractures, borehole leakoff pressure will be a measure of the minimum principal stress which holds these sub-vertical fractures closed.

Frequently both maximum and minimum far field stresses are measured in the same leakoff test. The second leakoff test at 10608 feet depicted graphically in FIG. 1 is an example of such a case. The short open borehole below 10608 feet probably contained one or more sub-horizontal bedding plane fractures. The leakoff test reached a peak pressure of 16.77 ppg, which is very close to the calculated overburden gradient at that depth. This corresponds to the upper pressure (Fph) illustrated on the inset leakoff test graph.

The escaping borehole fluid will follow its path of least resistance and propagate at the pressure that is holding that fracture closed. Sub-horizontal fractures are held closed by the maximum principal stress and sub-vertical fractures are held closed by the least principal stress. When borehole fluid traveling in a sub-horizontal fracture intersects a sub-vertical fracture, the path of least resistance will be the sub-vertical fracture. At that time, the borehole measured pressure will drop because the fluid has found a lower resistance path. If pumping is continued, borehole fluid will travel out into the formation at the propagation pressure of a sub-vertical fracture. This corresponds to (Fpv) on the inset leakoff test diagram. Usually leakoff tests are stopped well before this to avoid unnecessary damage to the borehole.

If the formation supports a constant bleed down pressure after the pumps are turned off, this fracture closure pressure is usually a good estimate of fracture propagation pressure (Fpv) and minimum horizontal stress. This is true because an existing fracture has essentially no tensile strength. In this test at 10608 feet (see FIG. 1), the observed bleed down pressure exactly matched the calculated fracture propagation pressure gradient of 15.7 ppg.

A third initial overburden constraint occurred at 14180 feet when the operator raised mud weight from 15.0 to 15.4 ppg. Circulation was lost at this time, indicating borehole fluid was escaping into fractures that had opened somewhere in the open borehole. The minimum vertical fracture propagation pressure shown on FIG. 1 below the 10688 casing shoe is at 10860 feet. The fracture pressure there is 15.4 ppg. This value constrains the initial overburden to be 100 psi less than an average initial overburden column at 7370 feet. Higher overburden would have raised calculated fracture pressure and the well would not lose circulation at 15.4 ppg pressure.

The use of leakoff test to calibrate initial overburden in this case resulted in an improvement of over 400% (30 psi error according to this improved technique vs 130 psi error using the prior art techniques of U.S. Pat. No. 4,981,037) in the value of calculated pore pressure and fracture pressure for the whole well. The resulting continuous pore pressure log on the left of FIG. 1 is within 200 psi of the equivalent mud weight pressure at the points where the operator raised mud weight due to hole response. This level of accuracy is highly desirable in order to use petrophysically calculated pore pressure to guide a drilling operation.

2. Effective stress - mineralogic compaction function calibration

Each of the minerals which compose a sedimentary rock has its own characteristic compaction function. Sedimentary mineral grains compact through mechanical and chemical pressure solution processes. A mineral's overall compaction resistance is directly proportional to its hardness and inversely proportional to it's solubility.

Figure 2:
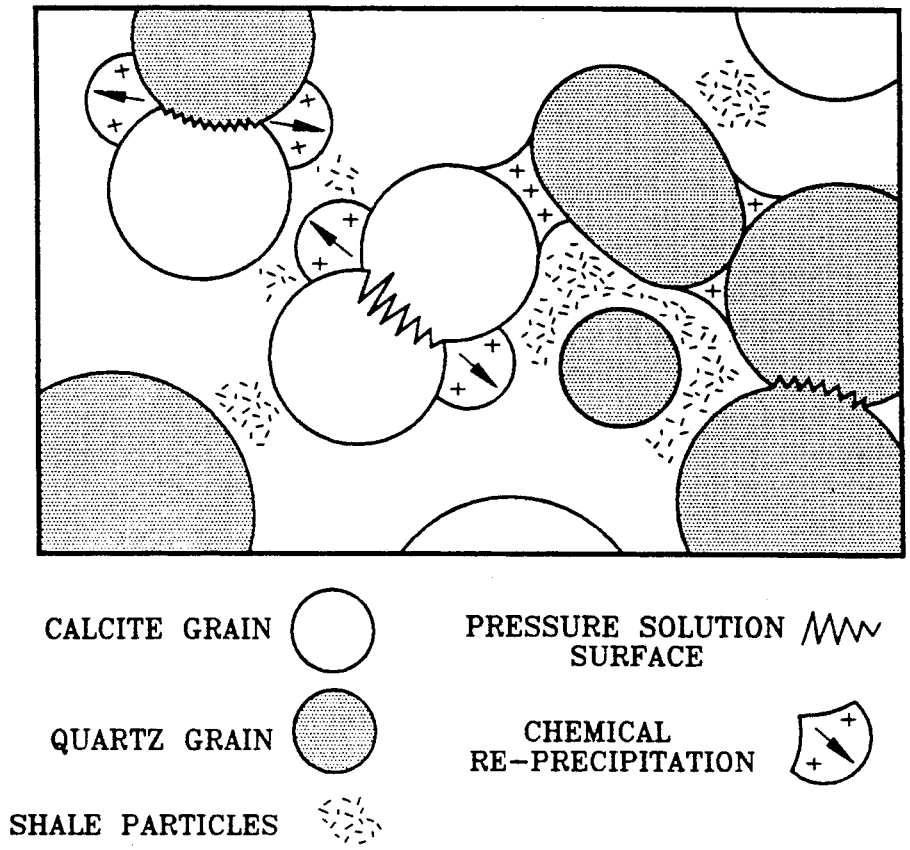
FIG. 2 is a schematic representation of mechanical and chemical compaction mechanisms for rock comprising calcite grains, quartz grains, and shale particles.

Most of our knowledge about sandstone and limestone compaction comes from sedimentary petrographers. Compaction conclusions of these petrographers are principally related to the purpose for their study. Petrographers typically have no knowledge of the stress conditions around the sedimentary rock sample which is observed in petrographic thin section. Typically a petrographic microscope will show hundreds of individual grains in a ¼ centimeter field of view. FIG. 2 conceptually shows the microscopic relationship between interpenetrating pressure solution surfaces for the most common sedimentary minerals, quartz, clay, and calcite. In FIG. 2, the harder less soluble quartz grains form bridges leaving porosity between the grains. The softer more soluble clay and calcite grains are preferentially dissolved at points of contact and re-precipitated locally in the pore space.

When observing these intergranular relationships, sedimentary petrographers broadly describe the quartz grains as load bearing. The calcite which occurs in the space between quartz grains is considered to be non-load bearing. This grossly oversimplifies the load bearing relationships between the minerals and leads to false conclusions about porosity and compaction. The space between quartz grains is called intergranular porosity, and this porosity is controlled by compaction of the quartz load bearing matrix. Calcite is 10,000 times softer than quartz and 20 times more soluble. Explanations by sedimentary petrographers of how porosity is gained or lost generally focus on the presence or absence of calcite between the quartz grains. Calcite is characterized as a non-load bearing cement whose occurrence is controlled only by fluid chemical processes.

A petrophysical logging instrument measures average porosity with accuracy approximately equal to a petrographic microscope, although the sample size is several cubic feet. This inherently broader viewpoint, combined with reasonable mineralogic stress-strain relationships, lead to some very different conclusions by a geologist about the effect of mineralogy on rock porosity. Using petrophysical data and the effective stress law, a geologist can determine the load bearing capacity of individual minerals with sufficient accuracy to calculate pore pressure.

Figure 3:
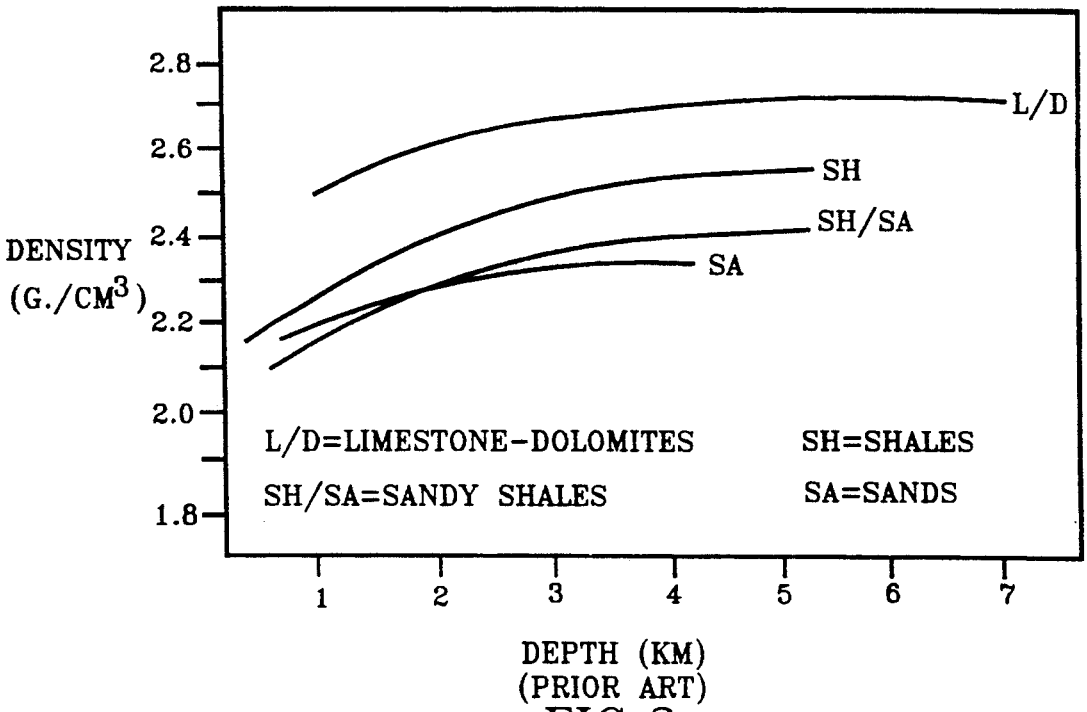
FIG. 3 graphically depicts average compaction curves for various lithologies from the Po Valley according to the prior art.

FIG. 3 illustrates a set of mineralogic end member compaction curves measured from petrophysical logs as published in 1987 by Gandino et al. These are typical of the non-mechanistic depth vs compaction functions prevalent in the geologic literature. The changes in observed bulk density that occur with depth are directly related to porosity because each mineral has a unique grain matrix density. The compaction functions are curved and widely spread, which would make it extremely difficult to construct a workable compaction function for mixed mineralogy rocks on the basis of this raw mono-mineralic petrophysical data.

Figure 4:
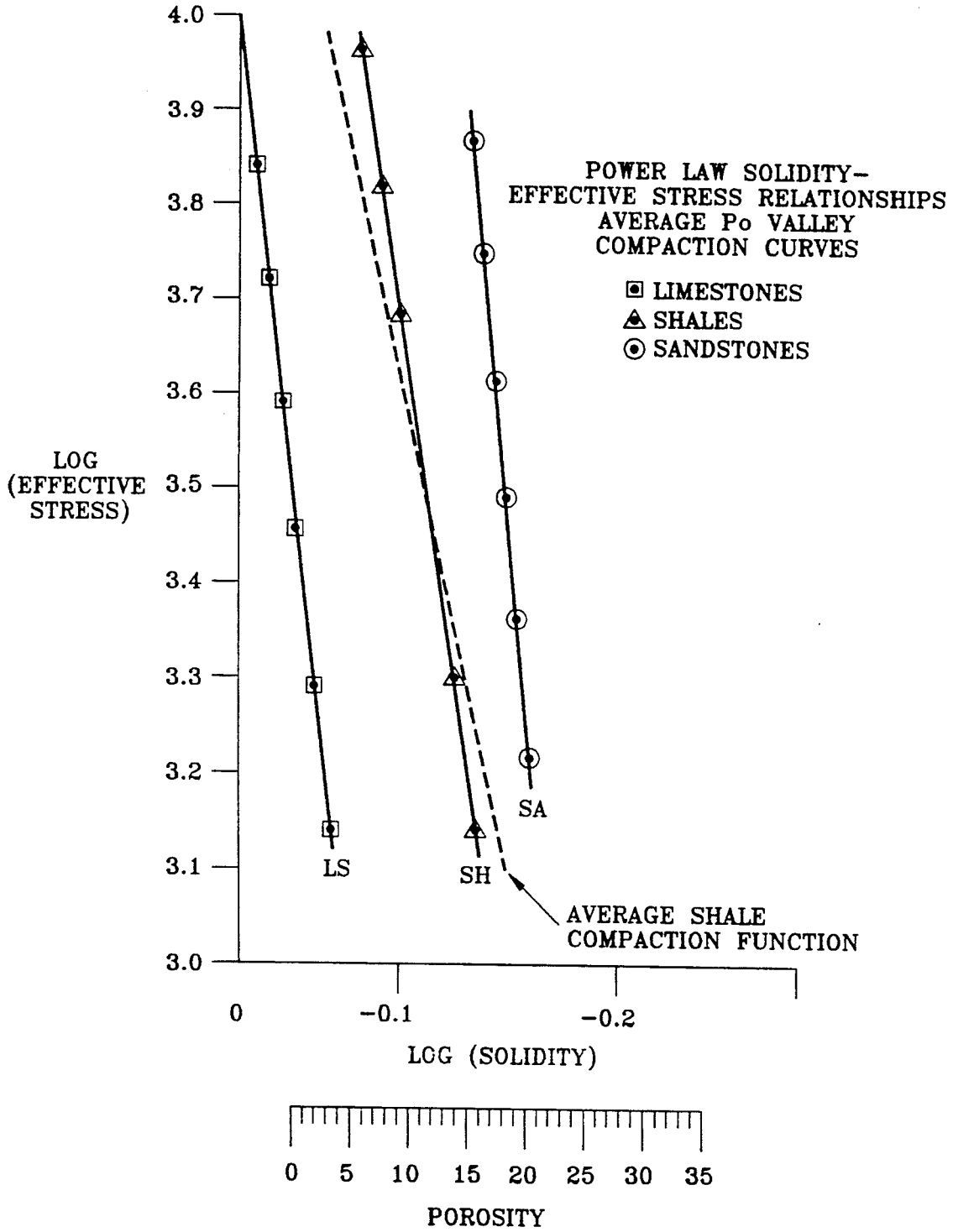
FIG. 4 graphically depicts stress as a function of porosity for various lithologies from the Po Valley data according to the present invention.

FIG. 4 shows the same Gandino et al compaction data recast as mechanical power law effective stress - solidity (grain matrix compactional strain) functions according to the present invention. An effective stress data point was calculated at each kilometer of burial depth. Actual mineral grain and fluid densities were used to convert bulk density to porosity and its complement solidity (1.0 - porosity=solidity). The compaction curves of FIG. 3 are thus the power law straight lines of FIG. 4.

The power law linear functions incorporate the observed strain hardening that occurs with each individual mineralogic end member. Strain hardening is the phenomenon of increased compaction resistance with decreasing porosity of granular solid materials. There is less than 2 porosity units deviation of the power law functions from the input data over the whole compaction range of all the curves. Thus the power law function accurately captures the strain hardening phenomenon for naturally deposited and compacted mono-mineralic sedimentary granular solids.

The intercept of each power law function with the 100% solidity axis represents the effective stress necessary to remove all porosity from naturally pure sedimentary particles of that granular solid mineral. The power law slope of each mono-mineralogic compaction function, i.e., delta log ($\sigma_v$)/delta log (solidity) is expressed simply as $\alpha$.

Table 1 shows the power law compaction functions for naturally sedimented pure minerals which have been naturally loaded during geologic burial. The halite compaction results were derived from the conversion of observed salt pan halite depth - porosity data published by Casas et al in 1989. The pure quartz sandstone compaction data is from clean Louisiana sandstones published by Atwater et al in 1965. The recast Gandino et al Po Valley compaction constants from their 1987 article have been effective stress tested in the North Sea and are described in Table 1 as calcite sand. Anhydrite constants were derived from Pfeifle et al laboratory compaction data published in 1981.

TABLE 1

Power Law Compaction Functions For Granular Naturally Sedimented Pure Minerals From Natural Gravitational Geologic Loading

| mineral (or rock) | $\sigma_{max}$ (psi) | log ($\sigma_{max}$) | $\alpha$ | hardness (mohs) | solubility (ppm) |
|---|---|---|---|---|---|
| Quartz Sand | 130000 | 5.114 | 13.219 | 7.0 | 6 |
| Average Shale | 18461 | 4.266 | 8.728 | 3.0 | 20 |
| Calcite Sand | 12000 | 4.079 | 13.000 | 3.0 | 140 |
| Anhydrite | 1585 | 3.200 | 20.00 | 2.5 | 3000 |
| Halite Sand | 85 | 1.929 | 31.909 | 2.0 | 350000 |

The $\sigma_{max}$ values calculated according to the present invention, and the previously known hardness and solubility data also shown on Table 1, are all mineral surface properties which represent mechanical and/or chemical compaction resistance. The mineralogic rank ordering that would result from any one of the three possible classification criteria are the same, which strongly supports the calculated $\sigma_{max}$ valves. Quartz is by far the mineral which is most resistant to compaction and halite (NaCl salt) is by far the least resistant to compaction. The $\sigma_{max}$ coefficient is a physically meaningful mineralogic stress-strain compaction resistance parameter. Table 1 shows that $\sigma_{max}$ is positively related to mineral hardness which should increase mechanical compaction resistance. The ability of a mineral to resist pressure solution compaction should decrease as the solubility of that mineral increases. A strong inverse relationship between $\sigma_{max}$ and mineral solubility is also evident on Table 1.

The mineralogic $\sigma_{max}$ and $\alpha$ constants shown in Table 1 will yield good estimates of effective stress over a wide stress range. However, other constants can yield the same numeric results over relatively narrow ranges of effective stress. Any combination of $\sigma_{max}$ and $\alpha$ constants which are $\pm 2$ porosity units of the preferred constants in the 1000 PSI to 4000 PSI; stress range could produce an equivalent effective stress and pore pressure log.

The reasonable range data in Table 2 below relates $\sigma_{max}$ and $\alpha$ values which would produce equivalent effective stress values under normal conditions.

TABLE 2

Reasonable $\sigma_{max}$ and $\alpha$ Ranges For Naturally Sedimented

| mineral (or rock) | $\sigma_{max}$ range (psi) | $\alpha$ Range (mohs) |
|---|---|---|
| Quartz Sand | 130,000–60,000 | 13.2–7.0 |
| Average Shale | 20,000–9,000 | 9.0–6.0 |
| Calcite Sand | 15,000–9,000 | 13.0–8.0 |
| Anhydrite | 2,000–1,000 | 22.0–8.0 |
| Halite Sand | 200–60 | 35.0–10.0 |

The above compilation of pure mineralogic end member data is vital for determining mineral surface compaction resistance. However, rarely do these pure end members, e.g., pure quartz sand or pure calcite sand, exist in nature. Rather the most common case is that a sedimentary rock is a natural mechanical mixture of these common rock forming minerals. The individual mineral grains settle together in a particular chemical environment under the influence of gravity. They are usually naturally sorted into narrow particle size and mineralogic categories. Geologists describe these common associations as lithology or depositional facies.

One overriding factor controlling the mineralogy of a sedimentary rock is chemical. Halite and anhydrite are precipitated from seawater under a very narrow range of basin geometric and arid climatic conditions. Calcite precipitates easily from warm seawater but is dissolved by cold seawater. Global climate which has varied through geologic time controls both average eustatic sea level and average water temperature. During upper and middle Cretaceous times, global climate was warm and there were no polar ice caps. Continental shelves were flooded with warm water shallow seas due to globally higher eustatic sea levels.

Sedimentary rocks deposited in warm waters during these warm sea climatic periods are dominantly mixtures of limestone and shale. The climatically associated higher sea level reduces quartz and clay input by reducing both the area and height of continental landmass which could contribute these sediments. Stratigraphic sequences deposited during these times are dominantly mixtures of calcite and clay with sedimentary quartz being only a minor constituent.

Sedimentary rocks deposited in cold waters or in overall cold climatic periods are predominantly quartz sand - shale sequences. Polar ice caps store water thus lowering eustatic sea level. This exposes greater land area to erosion and increases erosion rates due to steeper average land surface gradients. Quartz sediment supply is increased and calcite precipitation is prevented by the lower sea water temperature. In today's oceans, calcite precipitated in the warm surface waters is dissolved as it falls through the cold water column. Calcite never reaches the deep ocean abyssal plains which are red muds.

The combined climatic eustatic sea level effects divide sedimentary rocks into two broad mineralogic mixture categories. Essentially binary calcite - clay sedimentary mixtures dominate during globally warm times. Cooler climates prevent calcite precipitation. Relatively calcite free quartz sandstone - clay binary sedimentary mixtures dominate during these lowstand periods.

There is controversy regarding the relationships governing the compaction resistance of granular mineralogic mixtures, which have significant implications on the calculation of pore pressure from petrophysical data. Marion et al demonstrated in articles published in 1989 and 1992 that laboratory binary quartz sand - clay mixtures had a compactional porosity minimum between 10% and 40% clay at all levels of effective stress. The minimum porosity resulting from different packing relationships would appear to be a function of different particle size distributions of the two minerals. However, Thomas et al disclosed a linear relationship between shale content and porosity from petrophysical measurements of naturally sedimented and compacted quartz sand - clay mixtures in a 1975 article. Pittman et al also disclosed a near linear relationship between percent ductile grains and porosity for laboratory compacted mixtures in a 1991 publication. A linear relationship also exists between clay content and porosity at several different levels of effective stress in quartz sand - shale mixtures. In all three cases, higher ductile grain and clay content resulted in lower porosities upon compaction.

Another linear relationship has been determined to be present between porosity and shale content in limestone - shale stratigraphic sequences in the North Sea. The relationship was between the two pure mineralogic end member porosities inferred from the Gandino et al data published in 1987. In this case, the more soluble limestones had uniformly lower porosities upon compaction. These observations lead to the conclusion that compaction of these binary mineralogic mixtures is an approximately linear function of mineralogy.

Given the power law linear mineralogic compaction functions shown on Table 1 and the apparently linear porosity relationships between the end members, a rational and accurate method has been developed for calculating effective stress and consequently pore pressure for sedimentary rocks of any mineralogy. This method involves three basic steps:

1. Calculate the $\sigma_{max}$ exponent for the mixed mineralogy rock as the weighted average of the logarithms of pure end member $\sigma_{max}$ values shown on Table 1;

2. Calculate $\sigma_{max}$ for that mixed mineralogy rock by raising 10 to the $\sigma_{max}$ exponent; and 3. Calculate $\alpha$ for the mixed mineralogy rock as the weighted average of the individual pure end member $\alpha$ s.

Following this procedure, porosity and its complement solidity will be an approximately linear function of mineralogy at all levels of effective stress for all natural sedimentary mixtures. When applied to pore pressure calculations, the same (Equation 3) mineralogic power law function is applied consistently to any mixed mineralogy sedimentary rock over various stress and depth ranges. This assures consistent reproducible fluid pressure results from all lithologies under variable geologic conditions. Following this method and approach, geologic compaction is explained mechanistically in terms of sedimentary rock physical properties and stress.

The prior art relative compactional depth-porosity relationships explained as temperature - geologic age functions are equally well based upon sedimentary rock physical properties using the mechanically based mineralogy - effective stress relationships shown on Table 1. The latter method approach has the advantage of relating stress to sedimentary rock material (mineralogy, porosity) intrinsic physical properties. Higher geothermal gradients and temperatures are associated with higher compaction through the physical relationship between higher overburden density and thermal conductivity. The thermal conductivity of a sedimentary rock can be calculated as a weighted average of the individual mineral and fluid thermal conductivities, according to a 1990 publication by Briguad et al. Higher compaction is associated with higher temperature through higher overburden and effective stress.

Temperature cannot be ruled out as a contributing factor to sedimentary rock compaction. However, its effect on compaction is probably minor compared to the stress applied to the grain matrix. The melting points of the common sedimentary minerals listed on Table 1 are seven or more times higher than these minerals experience during compaction to zero porosity. Individual mineral mechanical crystal lattice strength is probably not affected significantly at these relatively low compaction temperatures. With the exception of anhydrites individual mineral solubility generally increases with temperature. Pressure solution compaction might be enhanced by increased temperature. However, the temperature effect cannot be properly evaluated unless one also considers compactional pressure, i.e., effective stress effects. If temperature were a significant controlling factor over compaction one would not see the many compaction reversals which have been observed and are related to pore fluid pressure. Temperature almost always increases steadily with depth, while compaction of the same mineral increases and decreases considerably.

The geologic age of a mineral has absolutely no effect on either its solubility or hardness. The law of superposition dictates that older rocks will underlay younger rocks. By this definition, both depth and geologic age are pseudo-stress variables. Older rocks are found on average to be more compacted because they are deeper. Older rocks are also under higher effective stress. In no way do these average depth relationships imply that geologic age is affecting compaction. Neither does geologic age control the rate of compaction. Pore fluids will obey the universal gas law and bear a mechanical load at elevated pressure for an infinite time if the fluid escape path is blocked. The compactional time dependence observed during the production of a reservoir is so fast that it is difficult to measure. The measured compaction of the Ekofisk field during 20 years of production from a 400 foot reservoir is 50 feet. The producing Ekofisk chalk apparently compacts almost as rapidly as the fluid is withdrawn. The load which was born by pore fluids for over 60 million years in the Ekofisk formation was transferred to the grain matrix as increased effective stress when fluid from the reservoir was produced. There is thus no apparent compactional time delay on the 20 year time scale. The effective stress natural compactional equilibration time for any rock is probably less than 100 years. Essentially every rock is in compaction equilibrium with its effective stress environment when it is initially cut by a drill bit. Beyond 100 years, geologic age is not a factor which affects compaction.

The three step mineralogic effective stress constant weighted averaging method described above is a significant improvement compared to previous compaction techniques. Although general end member compaction characteristics were known in the prior art, the interactions between compacting minerals was not known. The discovery of linear mineralogic mixing relationships is thus of tremendous importance. The inference that all mineralogic mixing is approximately linear and can be expressed as a simple weighted average is a significant extension of the observations. The compactional characteristics of the two evaporite minerals, halite and anhydrite, have not yet been studied.

Figure 5:
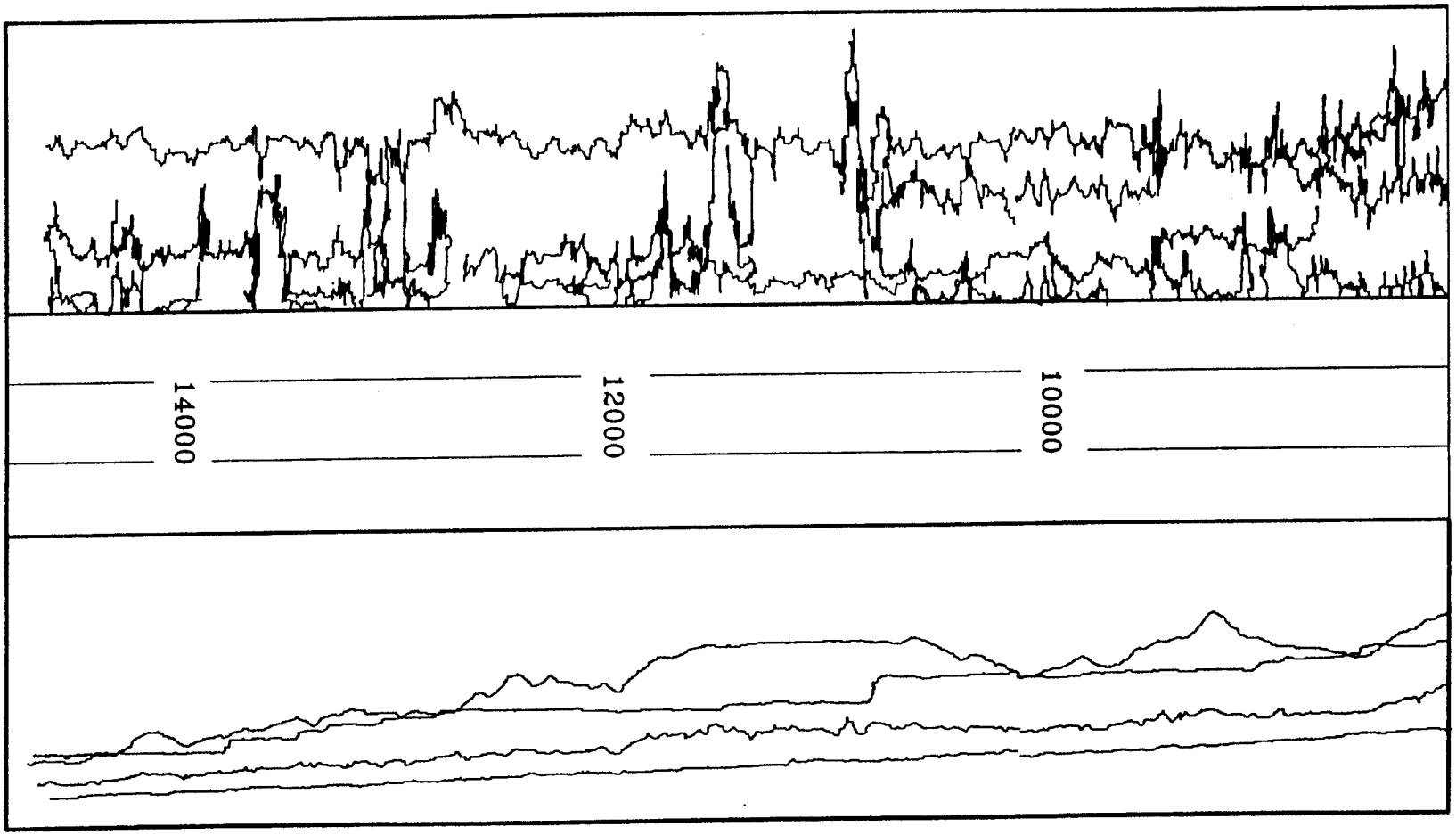
FIG. 5 graphically depicts input petrophysical well data displayed in the left side and the related critical pressure output data in the right side measured and calculated according to the present invention.

FIG. 5 graphically depicts information from a well in two different forms. The data on the left side of FIG. 4 represents input and intermediate calculated petrophysical data. The raw measured gamma ray data and normalized gamma ray shale volume are shown as two separate traces. Rock porosity calculated from resistivity data using an input water conductivity profile is also shown. The latter two parameters are used to calculate effective stress for given low gamma lithology constants $\alpha$ and $\sigma_{max}$.

The right side drawings represent the calculated critical pressure output curves. In each case (and preceding left to right), the first trace line is pore pressure, the second trace line corresponds to mud weight, the third trace is the fracture propagation pressure, and the fourth trace represents the overburden pressure. The units are the same as those provided in FIG. 1. The data itself is not the significant point. What is important is that it is clear that the calculated pore pressure trace line in FIG. 5 is both more accurate and more meaningfully displayed than the calculated pore pressure trace line shown in FIG. 1. Even those unskilled in the petrophysical pore pressure art will also appreciate the benefits of the displayed right side information in FIG. 5 compared to the left side information in FIG. 5. Drilling operators and well planners would clearly rather make determinations based on the calculated critical pressures rather than petrophysical data.

An exemplary procedure according to the present invention for calculating pore pressure and for providing additional useful information to a geologist or a well planner will now be described. The background for this procedure assumes that a borehole has been drilled from the earth's surface through compacted sedimentary rock for the purpose of recovering hydrocarbons. In a manner analogous to prior art techniques, the overburden will normally be calculated as a function of the depth of the rock (and if applicable a column of water above the rock for offshore applications). While an overburden log may be generated with this procedure, it should be understood that the overburden calculations are based solely on depth and the known or presumed rock composition at various depths. It should be understood that this overburden estimate procedure is not based on any measurement of overburden, but rather assumes that a certain type of rock, e.g., shale, likely will produce a range of overburden pressures at a certain depth. While various techniques may be used to calculate this assumed overburden, the most commonly used prior art technique is based on water column, sediment column, and rock makeup information. With this assumed overburden information, a fracture pressure log may be generated to give the well planner some initial guidance as to the maximum borehole pressure the well bore is capable of withstanding at any depth prior to formation fracture, so that both an initial overburden and fracture pressure log may be generated as a function of depth.

Each time a new casing string is set in the well bore, the drilling operator will normally conduct one or more leakoff tests to test the casing cement job and determine how far static mud weight can be raised before setting another casings string. According to the present invention, this leakoff test information is used to accurately determine overburden at one or more of these setting depths. If three casing strings are thus set in a well, all available leakoff test data from each casing setting will preferably be used. The propagation pressure of a subhorizontal fracture or overburden is then substantially equated to the maximum pressure obtained at a certain casing setting depth. The logical assumption is that this maximum leakoff pressure was the pressure required to "lift" the overlying rock sufficiently to open an existing subhorizontal fracture, and thereby lose fluid pressure. This maximum leakoff pressure is thus substantially equal to the, overburden pressure. Similarly, the minimum leakoff pressure at a given setting depth when circulation is lost is equated to the subvertical fracture pressure, since this lower pressure is the minimum pressure required to "open" a subvertical fracture. Between these maximum and minimum pressures, various other fractures at that setting depth may be opened. With this information, the initial overburden and fracture pressure logs may then be adjusted by constant amounts, so that all leakoff test pressures fall within the constant offset continuous logs.

The leakoff test procedure as described above is different than prior art procedures for calculating overburden in that actual overburden pressure is measured. It should be understood, however, that other techniques may also be used for directly measuring the overburden pressure. An example of a less favored technique utilizing a gravimeter was previously described.

With this more accurate technique for calculating overburden pressure and fracture pressure at various setting depths, a revised set of continuous logs may thus be generated using additional petrophysical measurements conventionally taken at well site. While petrophysically calculated data is thus "filled in" between setting depths based on information which is not a function of actual overburden pressure, the procedure is significantly more accurate since the data may be adjusted to fit known instead of presumed pressure data at certain depths. Using this procedure, rock porosity may be determined based upon a conventional resistivity sensor or bulk density sensor run in the well bore. Those skilled in the art will appreciate that solidity is the complement of porosity and equals 1.0 minus porosity. The volume or percent volume of a specific mineral, such as shale, limestone, or sandstone, may also be determined by conventional techniques for each interval depth of the borehole. One available technique for making this determination utilizes a gamma ray sensor to detect radioactive potassium which evidences shale content. Cutting or core samples may also be used for determining the volume of other minerals in the rock. This technique is frequently used, for example, to determine whether the mineral mixed with the shale is calcite limestone or quartz sandstone. Regardless of the technique utilized to determine the volume of the specific minerals in the rock at each interval depth, a grain density for pure minerals is generally known. Exemplary values for typical minerals are as follows: quartz—2.65 g/cc; calcite or shale—2.71 g/cc; anhydrite—2.96 g/cc; halite—2.15 g/cc. Using this information, the average rock grain density $p_g$ may be calculated based upon the mineral volume determinations and known mineral grain density values at each interval depth.

To calculate the true bulk density at each interval depth for both the rock and the fluid within the rock, information regarding the fluid and its characteristics as well as the porosity of the rock are taken into account. Assuming for example that the fluid in the rock at a specific depth is known or presumed to be water, the density of the water may be calculated as a function of the liquid pressure (which corresponds to the pore fluid pressure), liquid volume (which presumably is a function of porosity), the temperature of the liquid, and the characteristics of the liquid. The conventional well bore conductivity tool ma), be used to determine the salinity of water in the rock, and conventional temperature sensors may be used to determine temperature at a specific depth, so that this information can then be used to calculate the rock bulk density as a function of both the specific minerals in the rock and the fluid within the rock at each depth interval. Other techniques may be used for determining the characteristics of the fluid at etch interval and thus the density of the fluid. For example, the salinity of water may alternatively be determined from produced water samples. It should be understood that this procedure for adjusting a density of a rock as a function of not only the specific minerals in the rock at each depth but also as a function of the density of the fluid in the rock at that depth may not be essential for all operations, particularly if the rock has a low level of porosity and thus a low volume of fluid.

With these bulk density calculations at each interval depth, the overburden at each depth below a specific setting depth may be determined as a function of the calculated bulk density and depth to generate a continuous revised overburden log. Those skilled in the art will also appreciate that the procedure for determining bulk density as described above is based upon the volume of the specific minerals in the rock at each depth, but this bulk density determination could be generated based upon characteristic of the mineral, such as its mass or weight, which is directly related to its volume.

Research by the inventor has shown that the logarithm of the effective stress for a mineral plotted as a function of the logarithm of solidity is substantially a linear relationship, as shown in FIG. 4. With this information, the line intercept with the hundred percent solidity axis may be used to determine the logarithm of the maximum effective stress $\sigma_{max}$ for a specific mineral. Referring to FIG. 4, the logarithm of the maximum effective stress for limestone (calcite sand) is shown to be approximately 4.0. Revised plots and calculations for the maximum effective stress for various minerals are supplied in Table 1, and are reasonable range for those values are supplied in Table 2. Similarly, the compaction exponent $\alpha$ for various pure minerals is the slope of the line depicted graphically in FIG. 4, and currently preferred compaction exponent values and a reasonable range of compaction and exponent values for various minerals was previously set forth. A particular feature of the present invention is that these maximum effective stress and compaction exponent values may be used to calculate the actual effective stress and compaction exponent values for rock of various combinations of minerals, as explained above.

A weighted average of the maximum effective stress for a specific rock comprising determined or presumed volumes of specific minerals may thus be determined by the following equation:

$$\log(\sigma_{max}) = (V_{quartz} \times 5.11) + (V_{calcite} \times 4.07) + (V_{halite} \times 1.97) + V_{anhydrite} \times 3.20) + (V_{shale} \times 8.68) \quad (4)$$

With the calculation of the logarithm of maximum effective stress of the rock at each interval depth, e.g., one foot depth, the maximum effective stress for the rock at that depth may be easily determined by simply raising 10 to the power of the maximum effective stress value.

The weighted average of the whole rock compaction exponent $\alpha$ may similarly be determined as a function of the volume of each mineral in the rock at each specific depth and the previously referenced compaction exponent values for a pure mineral. Equation 5 thus expresses this relationship:

$$\alpha = (V_{quartz} \times 13.2) + (V_{calcite} \times 13.0) + (V_{halite} \times 30.0) + V_{anhydrite} \times 30.0) + (V_{shale} \times 8.68) \quad (5)$$

Using the above information, the effective stress at each depth interval $\sigma_v$ may be calculated as follows:

$$\sigma_v = \sigma_{max}\,(\text{Solidity})^{\alpha} \quad (6)$$

The overburden is then set as the upper physical limit for effective vertical stress. Any higher calculated value for overburden is not physically reasonable, and probably resulted from an error in the estimated measured petrophysical parameters. The lower physical limit for effective stress be set at 0 since subsurface rock is in a state of vertical tension. A log may thus be generated of continuous pore pressure P using the relationship:

$$P = \text{Overburden} - \sigma_v \quad (7)$$

As previously noted, the refined and more accurate technique for calculating pore pressure and generating the pore pressure log according to the present invention has particular utility for geologist and well planners. With the above information, additional information may also be readily generated. A continuous effective horizontal stress log may be obtained as a function of the solidity and effective stress values. It is important that effective horizontal stress is a function of solidity because effective stresses are transmitted only through the solid fraction of the rock. The first order effective horizontal stress can be calculated from Equation 8:

$$\sigma_h = (\text{Solidity})\ \sigma_v \quad (8)$$

A continuous log of fracture propagation pressure Fpv may also be obtained using the effective stress law relationship:

$$Fpv = P + \sigma_h \quad (9)$$

These critical calculated pressures may then be used to either modify a well plan or alter drilling practice. The well plan or drilling practice should be carried out such that the drilling fluid pressure gradient in the open hole is greater than the continuous pore pressure log and less than the continuous fracture propagation pressure log. The drilling fluid pressure gradient should be maintained above the highest calculated pore pressure. Protective casing should be set when a higher drilling fluid pressure gradient would fracture the weakest open hole formation.

The weighted average mineralogic method is a significant departure from the techniques primarily used today by geologic researchers familiar with compaction and pore pressure. As explained above, conventional geologic technology involves controlling factors such as depth, temperature and geologic age which are nonmechanistic and unsound. The position that rock composition (mineralogy and porosity) and not these other factors is controlling compaction and can be used to accurately calculate pore pressure is highly significant to the hydrocarbon recovery industry. This information should lead to many new and useful relationships which can be employed by geologists in the oil and gas industry.

The foregoing disclosure and description of the invention is illustrative and explanatory thereof, and various changes in the method steps and techniques described therein may be made within the scope of the appended claims without departing from the spirit of the invention.

What is claimed is:

1. A method of calculating pore pressure in naturally compacted sedimentary rock penetrated by a borehole drilled from the earth's surface, comprising:

(a) measuring formation overburden at a specific borehole depth;

(b) determining rock solidity at multiple incremental borehole depths;

(c) determining a volumetric proportion for each of a plurality of minerals in naturally compacted sedimentary rock at each of the multiple incremental borehole depths;

(d) calculating formation overburden at each of the multiple incremental borehole depths as a function of the measured formation overburden at the specific borehole depth and the determined volumetric proportion of each of the plurality of minerals at each of the respective multiple incremental borehole depths;

(e) calculating effective stress at each of the multiple incremental borehole depths as a function of maximum effective stress of each of the plurality of minerals in the sedimentary rock at each of the multiple incremental borehole depths and the determined rock solidity at each of the multiple incremental borehole depths; and (f) calculating pore pressure at each of the multiple incremental borehole depths as a function of the calculated formation overburden and the calculated effective stress at each of the multiple incremental borehole depths.

2. The method as defined in claim 1, wherein step (a) further comprises:

performing one or more leakoff tests at the specific borehole depth to measure a maximum formation test pressure and thereby determine overburden pressure at the specific borehole depth.

3. The method as defined in claim 2, further comprising:

measuring lost circulation pressure during the one or more leakoff tests to determine vertical fracture propagation pressure at the specific borehole depth.

4. The method as defined in claim 2, further comprising:

substantially equating the maximum measured formation test pressure with the measured formation overburden at the specific borehole depth.

5. The method as defined in claim 1, wherein step (a) further comprising:

measuring gravity at a surface of an open borehole and gravity at the specific borehole depth; and calculating the formation overburden at the specific borehole depth as a function of the measured gravity measurements.

6. The method as defined in claim 1, further comprising:

initially estimating formation overburden from rock density values and borehole depth; and adjusting the initial formation overburden estimates in response to the measured formation overburden.

7. The method as defined in claim 1, wherein step (b) comprises:

conducting one or more measurements in an open borehole at the multiple incremental borehole depths from a group consisting of resistivity measurements and bulk density measurements.

8. The method as defined in claim 1, wherein step (c) further comprises:

using a gamma ray sensor to determine a volumetric proportion of shale as one of the plurality of minerals in the rock at each of the multiple incremental borehole depths.

9. The method as defined in claim 1, wherein step (c) further comprises:

using rock samples to determine the volumetric proportion of each of the plurality of minerals in the rock at each of the multiple incremental borehole depths.

10. The method as defined in claim 1, further comprising:

calculating average grain density at each of the multiple incremental borehole depths as a function of pure mineral grain density and the determined volumetric proportion of each of the plurality of minerals in the rock at each of the multiple incremental borehole depths.

11. The method as defined in claim 10, further comprising:

determining fluid density in the sedimentary rock at each of the multiple incremental borehole depths; and determining bulk rock density at each of the multiple incremental borehole depths as a function of the calculated average grain density and the determined fluid density at each of the multiple incremental borehole depths.

12. The method as defined in claim 1, further comprising:

calculating bulk rock density at each of the multiple incremental borehole depths as a function of the determined rock solidity and the determined volumetric proportion of each of the plurality of minerals in the rock at each of the multiple incremental borehole depths.

13. The method as defined in claim 1, wherein step (e) comprises:

interpolating a linear relationship between a logarithm of effective stress for each of the plurality of minerals in the rock and the determined rock solidity at each of the multiple incremental borehole depths.

14. The method as defined in claim 13, further comprising:

based on the determined linear relationship, determining a logarithm of maximum effective stress for each of the plurality of minerals in the rock; and determining a compaction exponent for each of the plurality of minerals at each of the multiple incremental borehole depths.

15. The method as defined in claim 14, wherein the step of determining the compaction exponent comprises:

determining a slope of a linear relationship between the logarithm of effective stress for each of the plurality of minerals in the rock, and a logarithm of rock solidity for the respective plurality of minerals.

16. The method as defined in claim 14, further comprising:

determining a weighted average of a logarithm of maximum effective stress for the rock as a direct function of the logarithm of maximum effective stress for each of the plurality of minerals in the rock at each of the multiple incremental borehole depths and the determined volumetric proportion of each of the plurality of minerals in the rock.

17. The method as defined in claim 1, further comprising:

determining horizontal stress at each of the multiple incremental borehole depths as a function of the determined rock solidity and the calculated effective stress at each of the multiple incremental borehole depths.

18. The method as defined in claim 17, further comprising:

determining fracture propagation pressure at each of the multiple incremental borehole depths as a function of the calculated pore pressure and the determined horizontal stress at each of the multiple incremental borehole depths.

19. A method of calculating pore pressure in naturally compacted sedimentary rock penetrated by a borehole drilled from the earth's surface, comprising:

(a) determining formation overburden at each of multiple incremental borehole depths;

(b) determining rock solidity at each of the multiple incremental borehole depths;

(c) determining a volumetric proportion of each of a plurality of minerals in naturally compacted sedimentary rock at each of the multiple incremental borehole depths;

(d) determining a weighted average of a logarithm of maximum effective stress for each of the plurality of minerals in the sedimentary rock at each of the multiple incremental borehole depths as a function of the determined volumetric proportion of each of the plurality of minerals in the rock at the respective borehole depth and a logarithm of maximum effective stress for each of the plurality of minerals in the rock;

(e) calculating a weighted average of maximum effective stress of each of the plurality of minerals in the sedimentary rock at each of the multiple incremental borehole depths as a function of the calculated weighted average of the logarithm of maximum effective stress for each of the plurality of minerals in the sedimentary rock;

(f) calculating a weighted average compaction exponent of the sedimentary rock at each of the multiple incremental borehole depths as a function of the determined volumetric proportion of each of the plurality of minerals in the sedimentary rock and a compaction exponent for each of the plurality of minerals;

(g) calculating effective stress as a function of the calculated weighted average of maximum effective stress and 10 raised to a power, the power being equated to the calculated weighted average compaction exponent; and (h) calculating pore pressure at each of the multiple incremental borehole depths as a function of the determined formation overburden and the calculated effective stress.

20. The method as defined in claim 19, further comprising:

determining a logarithm of maximum effective stress for each of the plurality of minerals; and determining the compaction exponent for each of the plurality of minerals.

21. The method as defined in claim 19, further comprising:

calculating rock density as a function of the determined rock solidity and the determined volumetric proportion of each of the plurality of minerals in the rock at each of the multiple incremental borehole depths.

22. The method as defined in claim 19, wherein step (a) further comprising:

measuring formation overburden at least one borehole depth.

23. A method of calculating pore pressure in naturally compacted sedimentary rock penetrated by a borehole drilled from the earth's surface, comprising:

(a) determining formation overburden at each of multiple incremental borehole depths;

(b) determining rock solidity at each of the multiple incremental borehole depths;

(c) determining a volumetric proportion for each of a plurality of minerals in naturally compacted sedimentary rock at each of the multiple incremental borehole depths;

(d) calculating a weighted average compaction exponent of the sedimentary rock at each of the multiple incremental borehole depths as a function of the determined volumetric proportion of each of the plurality of minerals in the sedimentary rock and a compaction exponent for each of the plurality of minerals;

(e) calculating effective stress at each of the multiple incremental borehole depths as a function of maximum effective stress of each of the plurality of minerals in the sedimentary rock at each of the multiple incremental borehole depths and the calculated weighted average compaction exponent at each of the multiple incremental borehole depths; and (f) calculating pore pressure at each of the multiple incremental borehole depths as a function of the determined formation overburden and the calculated effective stress at each of the multiple incremental borehole depths.

* * * * *